US005713291A

United States Patent [19]

Mull, Jr.

[11] Patent Number: 5,713,291

[45] Date of Patent: Feb. 3, 1998

[54] ROTATED MULTI-CYLINDER AIR DELIVERY PORT

[75] Inventor: Ted V. Mull, Jr., Akron, Ohio

[73] Assignee: The Babcock & Wilcox Company, New Orleans, La.

[21] Appl. No.: 627,259

[22] Filed: Apr. 3, 1996

[51] Int. Cl.[6] ..... F23D 1/02

[52] U.S. Cl. ..... 110/264; 110/265

[58] Field of Search ..... 110/347, 346, 110/264, 265; 454/285, 153

[56] References Cited

U.S. PATENT DOCUMENTS

| | | | |
|---|---|---|---|
| 1,602,180 | 10/1926 | Stillman . | |
| 2,044,296 | 6/1936 | Hardgrove | 110/22 |
| 2,046,767 | 7/1936 | Campbell | 110/22 |
| 2,097,078 | 10/1937 | Peabody | 158/1.5 |
| 2,112,888 | 4/1938 | Greenwalt | 158/77 |
| 2,325,318 | 7/1943 | Hendrix | 110/104 |
| 2,515,813 | 7/1950 | Wiant | 158/1.5 |
| 2,647,568 | 8/1953 | Sloan | 158/76 |
| 3,049,085 | 8/1962 | Musat et al. | 110/28 |
| 4,457,241 | 7/1984 | Itse et al. | 110/347 |
| 4,602,571 | 7/1986 | Chadshay | 110/264 |
| 4,902,221 | 2/1990 | Collins, Jr. et al. | 431/183 |
| 5,347,937 | 9/1994 | Vatsky | 110/264 |

OTHER PUBLICATIONS

"Steam/Its Generation and Use", 40th ed., The Babcock & Wilcox Company, pp. 13–3 to 13–11, 1992.

*Primary Examiner*—William E. Tapolcal
*Assistant Examiner*—Gregory A. Wilson
*Attorney, Agent, or Firm*—Daniel S. Kalka; Robert J. Edwards

[57] ABSTRACT

A multi-cylinder air delivery port for introducing air into a fossil fuel-fired boiler and auxiliary equipment. The air delivery port is generally comprised of a linearly translatable and rotatable bundle of open ended cylinders that allow air to be injected with a directional and/or swirling flow pattern without the use of louvered damper blades and spin vanes of conventional air delivery ports.

11 Claims, 2 Drawing Sheets

ROTATED MULTI-CYLINDER AIR DELIVERY PORT

BACKGROUND OF THE INVENTION

1. Field of the Invention

The invention relates generally to an apparatus for the direction of air into a furnace and, more particularly, to a new and novel air delivery port generally comprised of a rotatable bundle of cylinders, which allows air to be injected into the furnace with a swirling flow pattern.

2. Description of the Related Art

In a conventional fossil fuel-fired boiler, air is delivered to the furnace interior and used therein not only to initiate and sustain burning of a fuel such as coal, oil or natural gas, but also to control the production of certain gaseous pollutants which may result from the fuel burning process. Typically, air is introduced into the furnace through a furnace wall at one or more annular air passages surrounding each burner and at one or more air delivery ports located above or below the burners. In such air delivery ports, louvered damper blades or spin vanes are routinely used to alter the flow pattern of the incoming air so that the air enters the boiler either at some desired angle relative to the furnace wall or with a spinning motion. FIG. 1A depicts a known air delivery port that employs louvered damper blades. FIG. 1B portrays a known air delivery port that makes use of spin vanes. In most instances, the louvered damper blades and the spin vanes are movable so that adjustments in the air flow pattern may be made for field tuning and to thereby enhance furnace performance. The flexibility afforded by field tuning has been found to be particularly advantageous in situations where air delivery port locations are restricted due to obstructions around the boiler setting.

SUMMARY OF THE INVENTION

The present invention is a novel air delivery port for boiler and auxiliary equipment applications. A plurality of cylinders open at both of their ends are loosely amassed into a bundle. A pair of plate-like, circular tube sheets are provided to support each of the cylinders at their ends and to thereby hold the cylinders together in the bundle. Each tube sheet is provided with a plurality of circular holes which are equal in number to the cylinders in the bundle and which are of a diameter that is just large enough to allow the ends of the cylinders to be loosely fitted into the tube sheet. One of the tube sheets is positioned in an aperture in a wall of the boiler, and the other of the tube sheets, along with the bundle of the cylinders, is situated within an air supply chamber, such as a windbox, that is connected to the boiler just outside the opening in the wall. The tube sheet within the air chamber is connected at a point on its periphery to a rigid bar or shaft that serves not only to support the tube sheet and the bundle, but also to rotate and/or translate the tube sheet and the ends of the cylinders fitted into the holes thereof. Air within the air chamber enters the cylinders through the cylinder ends situated in the air chamber, passes through the cylinders and flows into the boiler by exiting the cylinder ends that are fitted into the tube sheet positioned in the boiler wall aperture. By linearly translating the tube sheet located in the air chamber and holding the tube sheet in the boiler wall aperture stationary, the cylinders in the bundle can be aligned so that the air flowing in the cylinders is directed into the boiler at any desired angle. By rotating the tube sheet situated in the air chamber and either holding the tube sheet in the boiler wall aperture stationary or rotating that tube sheet in a direction opposite to that of the other tube sheet, the cylinders in the bundle can be arranged so that the air entering the boiler does so with a swirling or spinning air flow pattern. By both linearly translating and rotating the tube sheet located in the air chamber and either holding the tube sheet in the boiler wall aperture still or rotating it in a direction opposite to that of the other tube sheet, air can be made to enter the boiler with a combination of swirling and directional flow.

Accordingly, one aspect of the present invention is drawn to a multi-cylinder air delivery port which may be used with a fossil fuel-fired boiler and auxiliary equipment, this air delivery port being comprised of:

A plurality of cylinders open at both of their ends and loosely amassed into a bundle;

A first plate-like, circular tube sheet situated in an air supply chamber and provided with a plurality of circular holes equal in number to the number of cylinders in the bundle, each of the holes being of a diameter sufficiently large to allow an end of each of the cylinders to be loosely fitted into and supported by the tube sheet;

A second plate-like, circular tube sheet situated in an aperture in a wall of the boiler, the second tube sheet also being provided with a plurality of circular holes of like number to and with diameters sufficiently large for each of cylinders in the bundle to be fitted into and supported by the second tube sheet;

A rigid bar or shaft connected to the first tube sheet at a point on the outermost edge of the tube sheet and used as a means to linearly translate and/or to rotate the tube sheet and the ends of the cylinders inserted therein; and A means to rotate the second tube sheet and the ends of the cylinders inserted therein in a direction opposite to that direction in which the first tube sheet is rotated.

In accordance with a further aspect of the present invention, either of the tube sheets may be made to rotate in an oscillatory fashion from a clockwise to a counterclockwise direction, or vice versa, while the other tube sheet is held stationary. The oscillatory motion of the tube sheet will be transmitted to the cylinders fitted therein, and the air flowing in the cylinders will be directed into the boiler in a pattern that oscillates in accordance with the motion imparted to the cylinders.

Yet another aspect of the present invention is to provide an air delivery port that will be capable of producing all air flow patterns presently producible by conventional air delivery ports, but without the internal mechanical devices (louvered damper blades and spin vanes) employed in such air delivery ports. It is believed that by eliminating such mechanical devices a reduction in the pressure drop (draft loss) encountered with conventional air delivery ports can be obtained.

Yet a further aspect of the invention is to provide an air delivery port that may be produced and operated at costs below those presently associated with conventional air delivery ports.

Yet still another aspect of the present invention is to provide an air delivery port with a higher degree of flexibility for controlling swirl and/or direction of the air entering the boiler and to thus provide a port with field tuning capabilities that will be superior to those of conventional air delivery ports.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 2:
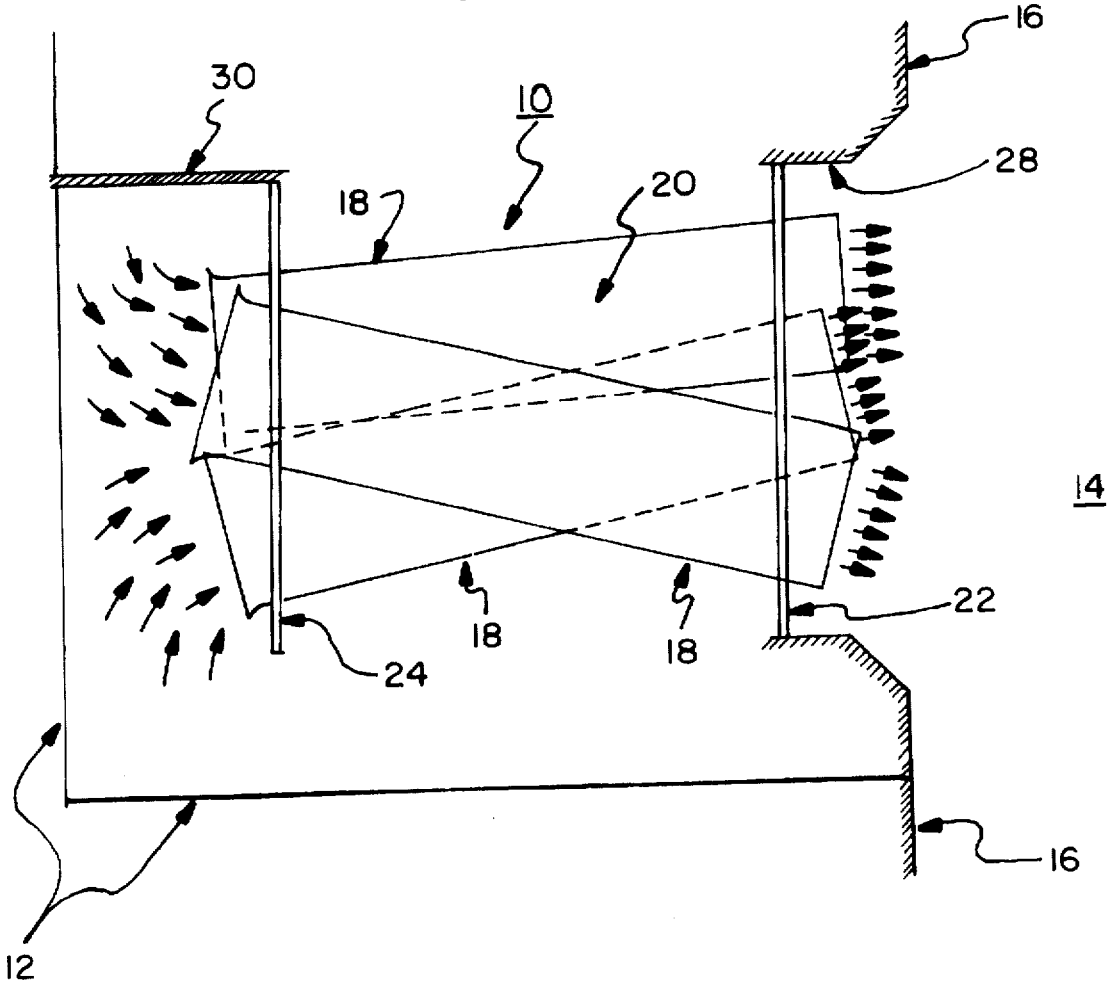
FIG. 2 Shows a side elevational view of an air delivery port according to the present invention.
Figure 3:
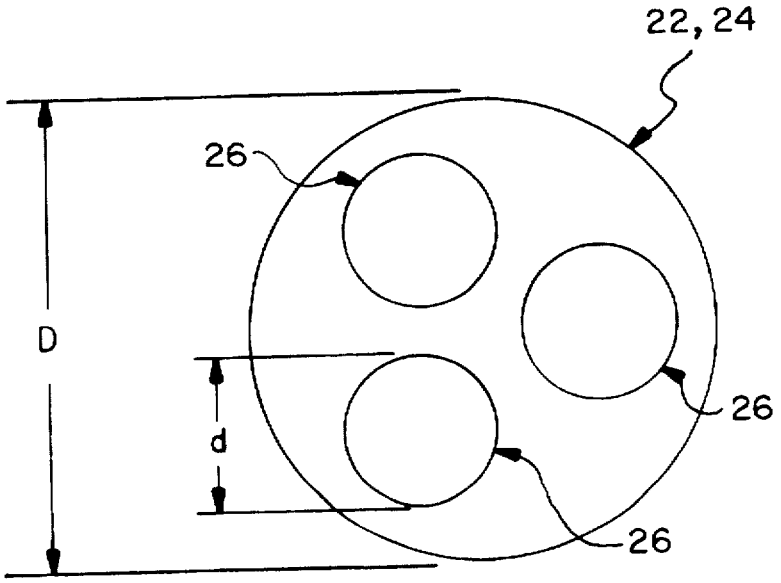
FIG. 3 Provides a front elevational view of a plate-like, circular tube sheet of the present invention.

FIG. 2 shows an air delivery port according to the present invention. Air delivery port 10 is situated within an air supply chamber, or windbox, 12 that is attached to a furnace 14 at the outside of a furnace wall 16. Air delivery port 10 has a plurality of cylinders 18 that are open at both ends and that are arranged loosely side by side to form a multi-cylindrical bundle 20. While multi-cylindrical bundle 20 is shown in FIG. 2 to contain three cylinders 18, it should be understood that the present invention need not be limited to any specific number of cylinders. The present invention also may include as few as two cylinders 18 and any number of cylinders 18 in excess of the three shown in FIG. 2. Cylinders 18 may be fabricated from any material suitable for use with the high temperatures commonly created by fossil fuel combustion in the furnace 14.

Figure 1A:
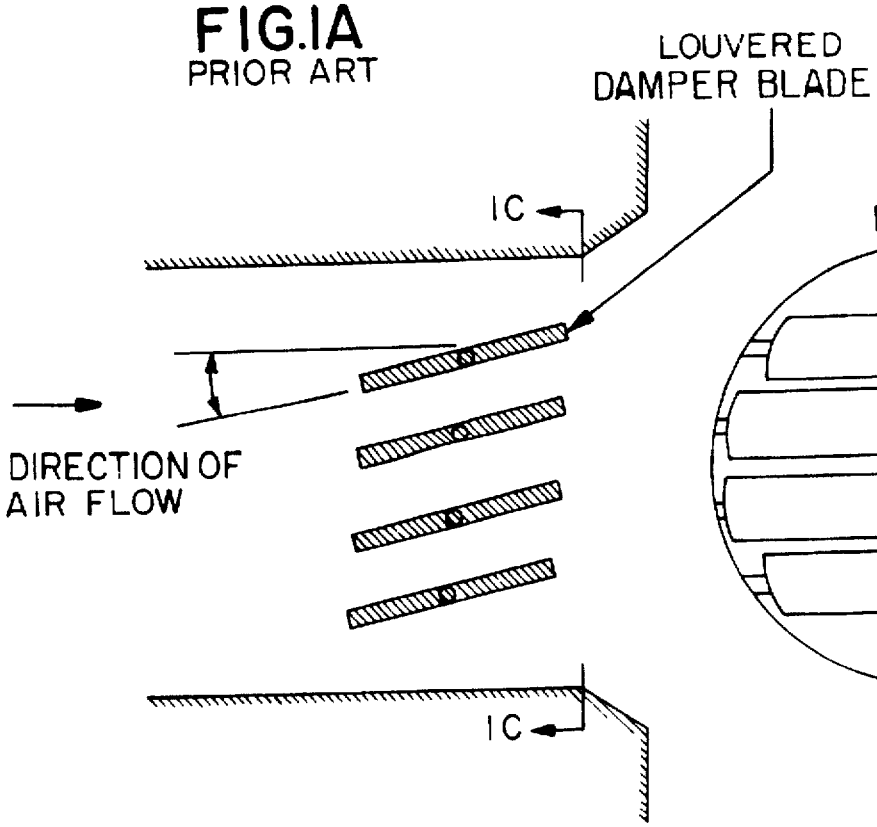
FIG.1A PRIOR ART
FIG. 1A Depicts a side cross sectional view of a conventional air delivery port that employs louvered damper blades to create a directional air flow.
Figure 1C:
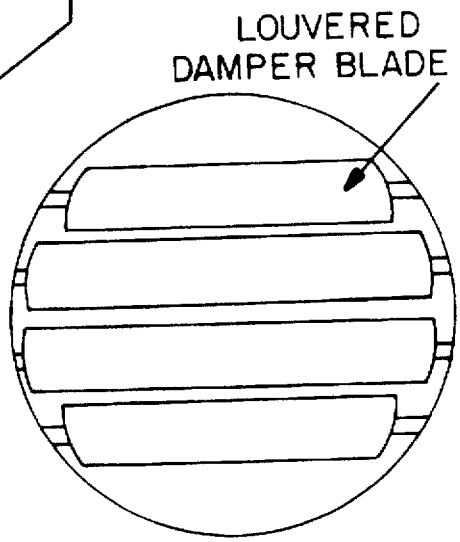
FIG.1C PRIOR ART
FIG. 1C Depicts an end view (taken along 1C—1C) of the conventional air delivery port of FIG. 1A.
Figure 1B:
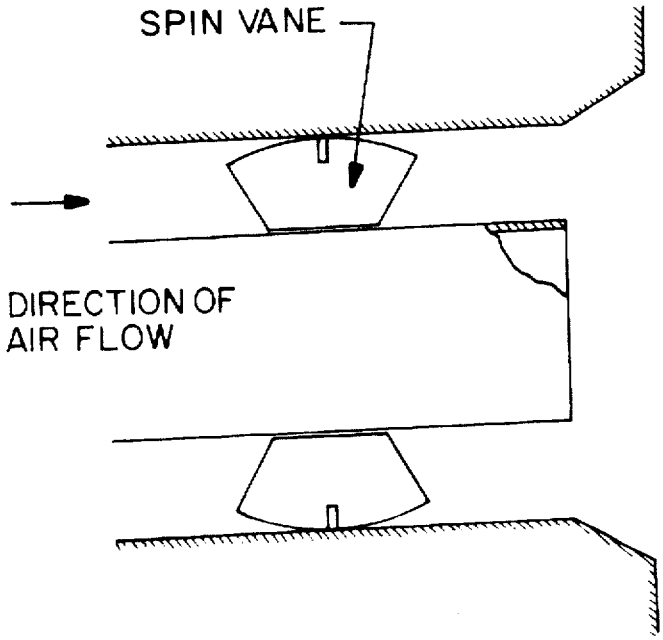
FIG.1B PRIOR ART
FIG. 1B Illustrates a side partial cross sectional view of a conventional air delivery port (dual-zone) that utilizes spin vanes to produce a swirling air flow.

In addition to multi-cylindrical bundle 20, air delivery port 10 has a pair of plate-like, circular tube sheets 22 and 24 that support each of cylinders 18 at their ends and thus hold them together as bundle 20. Tube sheets 22 and 24, which also will be made from suitable heat resistant material, are provided with a plurality of holes 26 that are equal in number to the number of cylinders 18 in bundle 20 and that are of a diameter, d, that is just large enough to allow an end of each of cylinders 18 to be loosely fitted into one of the holes 26. Tube sheet 22 is positioned within an aperture 28 in wall 16 of furnace 14 and has a diameter, D, that approximates the diameter of aperture 28. Tube sheet 24, along with bundle 20, is situated within air supply chamber 12. Tube sheet 24 is connected at a point on its periphery to a heat resistant, rigid bar, or shaft, 30 that serves not only to support tube sheet 24 and bundle 20, but also to transmit a force that will cause tube sheet 24 and the ends of cylinders 18 inserted therein to be moved in any of a number of directions within air supply chamber 12. Bar 30 may be employed to linearly translate tube sheet 24 and the ends of cylinders 18 vertically, horizontally, or along any other line lying within the plane of tube sheet 24 or any plane parallel thereto. Such translation aligns cylinders 18 so that air flowing in them is directed into furnace 14 at an angled flow pattern similar to one that otherwise could be produced by a louvered damper blade of a conventional air delivery port (FIG. 1A). Bar 30 also may be utilized to rotate tube sheet 24 about an axis passing perpendicularly through its center. Such rotation can be clockwise or counterclockwise in direction and will be limited in nature, because of the physical make-up of multi-cylindrical bundle 20, i.e., bundle 20 may be rotated only so far before cylinders 18 either will contact one another and thereby cause bundle 20 to bind or the ends of cylinders 18 will disengage from holes 26 in tube sheet 24, or possibly in tube sheet 22, and cause bundle 20 to come apart. Rotation of tube sheet 24 within permitted physical constraints causes cylinders 18 to become arranged in a manner so that air flowing through them enters furnace 14 with a swirling or spinning air flow pattern that otherwise could be obtained by using a spin vane of a traditional air delivery port (FIG. 2).

In addition to either linearly translating or rotating tube sheet 24, bar 30 also may be used to move tube sheet 24 in other ways and to thus produce other desirable air flow patterns that cannot be created by conventional air delivery ports. Bar 30 may be employed to produce a combined linear translation and rotation of tube sheet 24. Such combined movement arranges cylinders 18 so that air flowing in them will enter furnace 14 with a flow pattern that has both an angular (directional) component and a spinning or swirling component. The resultant flow pattern will have characteristics which heretofore have not been achievable with any conventional air delivery port using either louvered damper blades or spin vanes. Such conventional ports are capable of producing directional or swirling air flow patterns; however, such ports are incapable of producing both air flow pattern characteristics. Bar 30 may be used in yet another manner to cause tube sheet 24 to rotate in an oscillatory fashion from a clockwise to a counterclockwise direction, or vice versa. In turn, the oscillating motion of tube sheet 24 will be transmitted to cylinders 18 fitted therein, and the air flowing in them will be directed into furnace 14 with a pattern that oscillates in accordance with the motion imparted to cylinders 18.

For the most part, the foregoing description of the various types of movement of tube sheet 24 presupposes that tube sheet 22 will be held stationary within aperture 28. Such an assumption always need not be the case, however. Certain embodiments of the present invention may entail limited rotational movement of tube sheet 22 in a direction that is opposite to the rotational movement imparted to tube sheet 24. One such embodiment will involve the case where tube sheet 24 undergoes no linear translation, but it is subjected to clockwise or counterclockwise rotation. A second such embodiment will include the circumstance wherein tube sheet 24 is subjected to both linear translation and clockwise or counterclockwise rotation. Rotation of tube sheet 22 in a direction diametric to that of tube sheet 24 predictably will result in a swirling or spinning air flow pattern in the case where tube sheet 24 undergoes no linear translation and in a combined directional/swirling pattern in the instance where tube sheet 24 is subjected to linear translation.

Yet another embodiment of the present invention may be provided where tube sheet 22 is made to oscillate from a clockwise to a counterclockwise direction, or vice versa, while tube sheet 24 is not subjected to any rotational movement. Under such arrangement, tube sheet 24 may or may not be translated linearly. In either case, an oscillating air flow pattern will be created; however, where tube sheet 24 is linearly translated, the air flow pattern will be both oscillatory and directional in character.

For those embodiments of the present invention where one or the other of the above described types of rotational movement is imparted to tube sheet 22, such movement will be caused by a force transmitted through a means similar to bar 30. Such means will be rigidly attached at one of its ends to tube sheet 22, and it will be linked at the other end to a means for generating the force required to move tube sheet 22.

While specific embodiments of the invention have been shown and described in detail to illustrate the application of the principles of the invention, it will be understood that the invention may be embodied otherwise without departing from such principles.

What is claimed is:

1. A multi-cylinder air delivery port for introducing air into a furnace, the air delivery port comprising:

a plurality of cylinders open at both ends and arranged loosely side by side to form a multi-cylindrical bundle;

a first circular tube sheet situated in an air supply chamber and provided with a plurality of circular holes equal in number to the number of cylinders in the bundle, each of the holes being of a diameter just sufficiently large to allow an end of each of the cylinders to be loosely fitted into and supported by the tube sheet;

a second circular tube sheet situated in an aperture in a wall of a furnace, the second tube sheet also being provided with a plurality of circular holes of like number to and with diameters sufficiently large to allow an end of each of the cylinders in the bundle to be loosely fitted into and supported by the second tube sheet; and means for supporting and imparting movement to the first tube sheet.

2. An air delivery port according to claim 1, wherein the means for supporting and imparting movement to the first tube sheet is a rigid bar connected at one of its ends to the first tube sheet at a point on the outermost edge of the tube sheet.

3. An air delivery port according to claim 1, wherein the means for supporting and imparting movement to the first tube sheet linearly translates the first tube sheet and the ends of the cylinders fitted therein within a plane containing the first tube sheet, while the second tube sheet remains immobile in the aperture of the wall of the furnace.

4. An air delivery port according to claim 1, wherein the means for supporting and imparting movement to the first tube sheet partially rotates the first tube sheet about an axis that is perpendicular to and that passes through the center of a face of the first tube sheet, while the second tube sheet remains immobile in the aperture of the wall of the furnace.

5. An air delivery port according to claim 1, wherein the means for supporting and imparting movement to the first tube sheet linearly translates the first tube sheet within a plane containing the first tube sheet and partially rotates the first tube sheet about an axis that is perpendicular to and that passes through the center of a face of the first tube sheet, while the second tube sheet remains immobile in the aperture of the wall of the furnace.

6. An air delivery port according to claim 1, wherein the means for supporting and imparting movement to the first tube sheet rotates the first tube sheet in an oscillatory manner about an axis that is perpendicular to and that passes through the center of a face of the first tube sheet, while the second tube sheet remains immobile in the aperture of the wall of the furnace.

7. An air delivery port according to claim 1, wherein the means for supporting and imparting movement to the first tube sheet linearly translates the first tube sheet within a plane containing the first tube sheet and rotates the first tube sheet in an oscillatory manner about an axis that is perpendicular to and that passes through the center of a face of the first tube sheet, while the second tube sheet remains immobile in the aperture of the wall of the furnace.

8. An air delivery port according to claim 1, further comprising means for imparting rotational movement to the second tube sheet to partially rotate the second tube sheet about an axis that is perpendicular to and that passes through a face of the second tube sheet, with the second tube sheet being rotated in a direction that is opposite to the direction in which the first tube sheet was rotated.

9. An air delivery port according to claim 8, wherein the means for supporting and imparting movement to the first tube sheet linearly translates the first tube sheet within a plane containing the first tube sheet and partially rotates the first tube sheet about an axis that is perpendicular to and that passes through the center of a face of the first tube sheet and wherein the means for imparting rotational movement to the second tube sheet partially rotates the second tube sheet about an axis that is perpendicular to and that passes through the center of a face of the second tube sheet, with the second tube sheet being rotated in a direction that is opposite to the direction in which the first tube sheet is rotated.

10. An air delivery port according to claim 8, wherein the means for imparting rotational movement to the second tube sheet rotates the second tube sheet in an oscillatory manner about an axis that is perpendicular to and that passes through the center of a face of the second tube sheet, while the first tube sheet is neither linearly translated nor partially rotated by the means for supporting and imparting movement to the first tube sheet.

11. An air delivery port according to claim 8, wherein the means for imparting rotational movement to the second tube sheet rotates the second tube sheet in an oscillatory manner about an axis that is perpendicular to and that passes through the center of a face of the second tube sheet, and the first tube sheet is linearly translated within a plane containing the first tube sheet.

* * * * *